US005090375A

United States Patent [19]

Hudson

[11] Patent Number: 5,090,375

[45] Date of Patent: Feb. 25, 1992

[54] VALVE GEAR OILING SYSTEM FOR OVERHEAD CAMSHAFT ENGINE

[75] Inventor: Eric B. Hudson, Hilbert, Wis.

[73] Assignee: Tecumseh Products Company, Tecumseh, Mich.

[21] Appl. No.: 618,167

[22] Filed: Nov. 26, 1990

[51] Int. Cl.[5] ..... F01M 1/06

[52] U.S. Cl. ..... 123/196 W; 123/196 R; 184/6.18

[58] Field of Search ..... 123/196 R, 196 W; 184/6.18

[56] References Cited

U.S. PATENT DOCUMENTS

| | | | |
|---|---|---|---|
| 1,864,314 | 6/1932 | Morrill | 184/6.9 |
| 2,404,295 | 7/1946 | Klinger | 384/276 |
| 3,140,757 | 7/1964 | Sampietro | 184/6.5 |
| 3,352,293 | 11/1967 | Hulten | 123/90.27 |
| 3,412,720 | 11/1968 | Binder | 123/90.27 |
| 4,329,949 | 5/1982 | Abts et al. | 123/90.34 |
| 4,343,270 | 8/1982 | Kawabe | 123/196 V |
| 4,418,658 | 12/1983 | DiRoss | 123/80 D |
| 4,601,267 | 7/1986 | Kronich | 123/90.33 |
| 4,611,559 | 9/1986 | Sumigawa | 123/196 W |
| 4,662,323 | 5/1987 | Moriya | 123/90.23 |
| 4,683,847 | 8/1987 | Fujikawa et al. | 123/90.2 |
| 4,688,529 | 8/1987 | Mitadera et al. | 123/196 R |
| 4,762,098 | 8/1988 | Tamba et al. | 123/90.33 |
| 4,771,745 | 9/1988 | Nakamura et al. | 123/196 R |
| 4,805,565 | 2/1989 | Sato et al. | 123/196 W |
| 4,926,814 | 5/1990 | Bonde | 123/196 W |
| 4,974,562 | 12/1990 | Ishii et al. | 123/196 W |

*Primary Examiner*—E. Rollins Cross
*Assistant Examiner*—Erick Solis
*Attorney, Agent, or Firm*—Baker & Daniels

[57] ABSTRACT

A single cylinder, overhead cam, internal combustion engine lubrication system where lubricating oil is pumped from a crankcase oil sump through oil passages to the upper bearings of the crankshaft and camshaft. The oil leaks from the bearings, adheres and flows down the shafts which is flung by rotation thereby lubricating the cam lobes and valve tappets. Oil, accumulating in the cam chamber sump, lubricates the lower camshaft bearing before being pumped through the closed loop circulatory system.

7 Claims, 1 Drawing Sheet

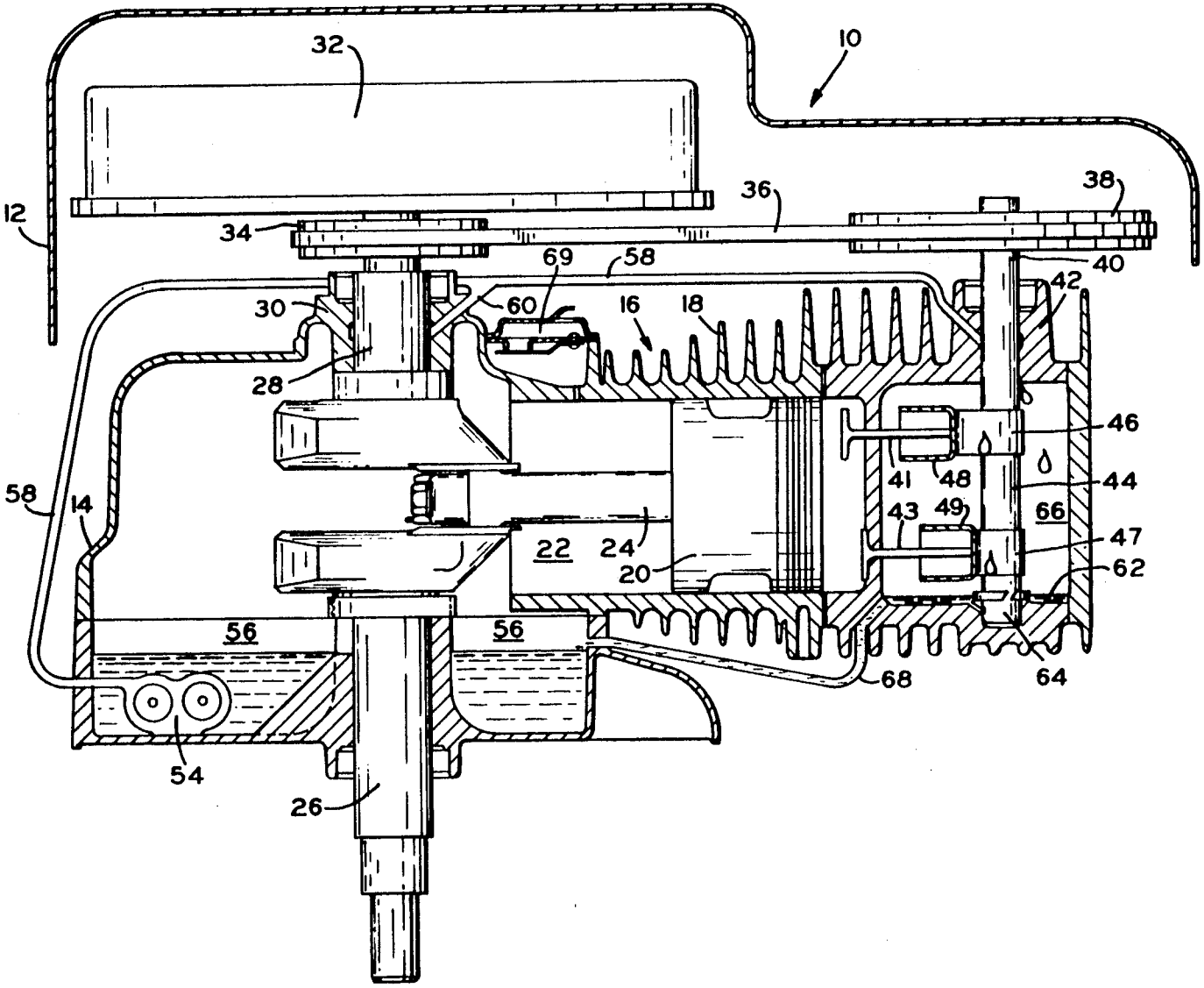
10
12
14
16
18
20
22
24
26
28
30
32
34
36
38
40
41
42
43
44
46
47
48
49
54
56
56
58
58
60
62
64
66
68
69

VALVE GEAR OILING SYSTEM FOR OVERHEAD CAMSHAFT ENGINE

BACKGROUND OF THE INVENTION

The present invention relates generally to the lubrication of internal combustion engines and, more particularly, to a lubrication system for a vertically oriented, overhead cam, single cylinder, internal combustion engine.

In a vertically oriented overhead cam internal combustion engine, as in any engine, it is necessary to lubricate the moving parts within the engine by means of a lubrication system. This lubrication system must effectively and efficiently lubricate parts such as the crankshaft bearings, piston, camshaft bearings, cam lobes, and valves so that heat and friction will not damage the engine.

Prior art lubrication systems for engines generally involve pumping oil through a hollow camshaft or crankshaft to be dispersed by rotation and gravity through small openings at various locations along the length of the shaft, or providing passages cast integrally within the cylinder block in which the oil may flow to the desired locations. Another method is to generate an oil mist by an impeller splashing in the oil sump. These methods often result in costly manufacture or inefficient lubrication when applied to an engine of the present type.

It is therefore desired to provide a simple, effective and efficient lubrication system for a vertically oriented overhead cam engine.

SUMMARY OF THE INVENTION

The present invention provides a lubrication system utilizing a partial vacuum, gravity, viscous adhesion properties of the oil, and rotation to distribute the oil, thereby effectively and efficiently lubricating all necessary parts.

The invention, in one form thereof, provides a lubrication system for a single cylinder overhead cam internal combustion engine wherein internal oil passages or oil passage tubes external to the engine block supply pressure fed oil to the upper bearing of the camshaft. The oil adheres to the camshaft and descends toward the oil sump in the cam chamber while a portion of the oil is flung off to provide lubrication for other valve train components. The oil collects in the cam chamber oil sump which is fed to the lower camshaft bearing for lubrication. The oil is then recirculated back to the main oil sump. A partial vacuum in the crankcase assists in the return of the excess oil in the cam chamber sump to the main oil sump.

One advantage of the present invention is that it is simple in construction and low in cost yet very effective in lubricating the cam bearing, cam gear and cam-valve stem interface.

BRIEF DESCRIPTION OF THE DRAWING

The above mentioned and other features and objects of this invention, and the manner of attaining them, will become more apparent and the invention itself will be better understood by reference to the following description of an embodiment of the invention taken in conjunction with the accompanying drawing, wherein:

The drawing is a diagrammatic sectional view of a single cylinder engine according to the present invention taken along a vertical plane.

The exemplification set out herein illustrates an embodiment of the invention, in one form thereof, and such exemplification is not to be construed as limiting the scope of the disclosure or the scope of the invention in any manner.

DESCRIPTION OF THE PREFERRED EMBODIMENT

Referring now to the drawing, an engine 10 is shown including a blower housing 12, a crankcase 14 and cylinder 16 With cooling fins 18 for dissipating heat. Piston 20, situated in cylinder bore 22 of cylinder 16 is attached by connecting rod 24 to crankshaft 26 wherein upper crankshaft journal 28 is rotatably received within upper crankshaft bearing 30 in crankcase 14. Mounted axially outward to upper crankshaft journal 28 and axially inward to flywheel 32 is crankshaft pulley 34 drivingly engaged by timing belt 36 to camshaft pulley 38 attached to and mounted axially outward to upper camshaft journal 40 rotatably received within upper camshaft bearing 42 for camshaft 44. The camshaft 44 has spaced cam lobes 46 and 47 located adjacent valves 41 and 43 having valve actuating means such as tappets 48 and 49.

In effecting lubrication, an oil pump 54 is located within an oil sump 56 of crankcase 14 where an oil reserve is defined. The oil pump 54 is in fluid communication with the upper camshaft bearing 42 through an oil passage tube 58 and circulates the oil through oil passage tube 58 delivering it to the upper camshaft bearing 42. The oil leaks from the upper camshaft bearing 42, and because of the viscous adhesion property of oil, clings to and by gravity descends the camshaft 44 and cam lobes 46 and 47. The oil is flung by camshaft rotation to the valve tappets 48 and 49. The flung oil impinges on the parts providing lubrication and then drips off and collects in an oil sump 62 defined at the lower camshaft bearing 64 within cam chamber 66. Oil sump 62 collects the falling oil, forming a pool or reservoir of oil which surrounds and lubricates the lower camshaft bearing 64. The lubrication can be effected, for example, by a passageway or a slight clearance between the camshaft and the camshaft bearing to form an oil film. Sump 62 also includes means for recirculating the oil to the main oil sump 56 through an oil drain passage tube 68 to begin the closed loop cycle again.

A crankcase vacuum maintained by a one way crankcase breather valve 69 can assist gravity in the return of the oil from oil sump 62 to the main oil sump 56. Built-in leakage around the stems of valves 41 and 43 or a small vent in the cam chamber (not shown) reduces the normal internal engine vacuum in the valve gear area. It is this slightly higher pressure in cam chamber 66 which helps move the oil from the oil sump 62 to flow through the oil sump passage tube 68 into the main oil sump 56.

In order to also lubricate the crankshaft 26 and piston 20 n within the cylinder bore 22, an oil passage 60 is in fluid communication with the oil passage tube 58 and the upper crankshaft bearing 30. The lubricating oil is delivered to the upper bearing 30 and by gravity drips back into oil sump 56 to cycle back through the closed loop system.

As an alternative to external oil passage tubes, internal oil passages could be machined in the crankcase.

This configuration would function and operate identically to the external oil passage tubes.

What has therefore been shown is a vacuum and gravity assisted lubrication system for a vertically oriented overhead cam single cylinder internal combustion engine whereby the camshaft, valve gear and crankshaft are lubricated by oil pumped through passages and forced to leak from the respective upper bearings. The oil descends from the upper bearings and is flung by rotation throughout the cam chamber and crankcase, thereafter collecting in the crankcase sump 56 and the camshaft oil sump 62, oil in the latter returning to the main sump 56 to again cycle through the closed loop circulation system.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A single cylinder, overhead cam, internal combustion engine, comprising:

a crankcase including a main oil sump and a cam chamber;

an oil sump in said cam chamber;

a vertical crankshaft rotatably supported by an upper crankshaft bearing and a lower crankshaft bearing in said crankcase;

a vertical camshaft rotatably supported by an upper camshaft bearing and a lower camshaft bearing and extending through said cam chamber;

intake and exhaust valves;

valve actuating means operably connected to said valves;

cam lobes on said camshaft operably connected with said valve actuating means; and lubrication means for supplying oil under pressure from said main oil sump to said upper camshaft bearing, whereby said camshaft, said cam lobes, and said valve actuating means are lubricated by oil falling from said upper camshaft bearing, adhering to said camshaft and flung radially outward by camshaft rotation, said lubrication means comprising an oil pump in fluid communication with said main oil sump, wherein said lower camshaft bearing is lubricated by oil within said cam chamber oil sump.

2. The engine of claim 1, wherein a pressure differential between said cam chamber oil sump and said main oil sump assists gravity in returning excess oil in said cam chamber oil sump to said main oil sump.

3. A single cylinder, overhead cam, internal combustion engine, comprising:

a crankcase including a main oil sump and a cam chamber;

a vertical crankshaft rotatably supported by an upper crankshaft bearing and a lower crankshaft bearing in said crankcase;

vertical camshaft rotatably supported by an upper camshaft bearing and a lower camshaft bearing and extending through said cam chamber;

an oil sump located in said cam chamber for lubricating said lower camshaft bearing, said cam chamber oil sump including recirculating means for returning the oil therein to said main oil sump;

intake and exhaust valves;

valve actuating means operably connected to said valves;

cam lobes on said camshaft operably connected with said valve actuating means; and lubrication means for supplying oil under pressure from said main oil sump to said upper camshaft bearing, whereby said camshaft, said cam lobes, and said valve actuating means are lubricated by oil falling from said upper camshaft bearing, adhering to said camshaft and flung radially outward by camshaft rotation.

4. The engine of claim 3, wherein said lubrication means comprises an oil pump in fluid communication with said main oil sump.

5. The engine of claim 4, wherein said lubrication means includes oil passages formed integrally within said crankcase.

6. The engine of claim 4, wherein said lubrication means supplies oil to said upper crankshaft bearing.

7. The engine of claim 4, wherein said valve actuating means are tappets.

* * * * *